United States Patent [19]

Pask

[11] 4,453,384

[45] Jun. 12, 1984

[54] FUEL BURNERS AND COMBUSTION EQUIPMENT FOR USE IN GAS TURBINE ENGINES

[75] Inventor: George Pask, Stanton-by-bridge, England

[73] Assignee: Rolls-Royce Limited, London, England

[21] Appl. No.: 333,572

[22] Filed: Dec. 22, 1981

[30] Foreign Application Priority Data

Feb. 21, 1981 [GB] United Kingdom ..... 8105578

[51] Int. Cl.[3] ..... F02C 7/22

[52] U.S. Cl. ..... 60/737; 60/39.31; 60/742; 60/748

[58] Field of Search ..... 60/39.31, 734, 737, 60/738, 740, 742, 748; 239/406

[56] References Cited

U.S. PATENT DOCUMENTS

| | | | |
|---|---|---|---|
| 3,283,502 | 11/1966 | Lefebvre | 60/742 X |
| 3,398,529 | 8/1968 | Schmitz et al. | 60/39.31 |
| 3,800,530 | 4/1974 | Nash | 60/262 X |
| 4,170,108 | 10/1979 | Mobsby | 60/740 |
| 4,237,694 | 12/1980 | Wood et al. | 60/738 |

FOREIGN PATENT DOCUMENTS

| | | |
|---|---|---|
| 670247 | 4/1952 | United Kingdom . |
| 673536 | 6/1952 | United Kingdom . |
| 768370 | 2/1957 | United Kingdom . |
| 1065705 | 4/1967 | United Kingdom . |
| 1467720 | 3/1977 | United Kingdom . |

*Primary Examiner*—Louis J. Casaregola
*Assistant Examiner*—Donald E. Stout
*Attorney, Agent, or Firm*—Cushman, Darby & Cushman

[57] ABSTRACT

The invention relates to fuel burners and the combination of fuel burners and annular combustion equipment particularly for use in gas turbine engines.

The present invention seeks to provide a fuel burner that requires a relatively small access hole in the engine casing in order to reduce stress concentrations in the casing.

The fuel burner comprises a fuel feed arm and a fuel injector. The fuel feed arm and the fuel injector are cylindrical, and are arranged coaxially in end-to-end abutting relationship. The fuel feed arm has internal passages for the supply of fuel to the fuel injector, and the fuel injector has an air duct passing normally through the fuel injector for the flow of air into a cooperating combustion chamber. The fuel injector supplies fuel into the air duct to mix with the air flowing therethrough.

The invention also provides combustion chamber equipment for use in conjunction with the fuel burners.

10 Claims, 7 Drawing Figures

Figure 1:
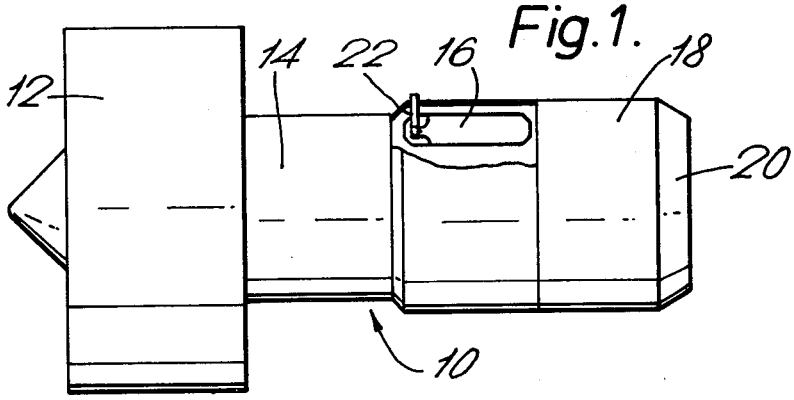

22
54
50
OUTBOARD
52
53
48
58
28
26
38
16
55
56
24
34
60
UPSTREAM
62
DOWNSTREAM.
36
35
33
70
74
44
37
42
32
40
68
A
76
78
64
46
72
67
66
INBOARD
30
B

C
22
114
108
112
110
102
106
50
52
53
OUTBOARD
16
58
48
28
26
55
38
56
24
UPSTREAM
60
34
62
36
DOWNSTREAM
33
35
44
74
42
32
37
70
40
A
68
76
64
72
78
67
46
66
104
100
30
B
INBOARD

FUEL BURNERS AND COMBUSTION EQUIPMENT FOR USE IN GAS TURBINE ENGINES

This invention relates to fuel burners and the combination of fuel burners and annular combustion equipment for use in gas turbine engines.

It is necessary that fuel and air are thoroughly mixed in gas turbine flame tubes, and a number of methods are available to achieve such mixing.

A more uniform mixing of fuel and air throughout the annular flame tube used in annular combustion equipment can be obtained by using larger numbers of fuel burners for a given annular flame tube.

The use of larger numbers of fuel burners creates several disadvantages, such as the weight of the engine is increased, and the stress in the casing is increased becasue of the increase in the numbers of holes in the casing.

Fuel burners tend to be large and bulky and require relatively large access holes in the casing, and these holes create stress concentrations.

The present invention seeks to provide a fuel burner that requires a relatively smaller access hole in the casing. The advantages resulting from such a fuel burner are that, a reduction in weight of the engine could be achieved and a reduction in the stress concentrations in the casing could be obtained.

Accordingly the present invention provides a fuel burner comprising a fuel feed arm and a fuel injector, the fuel feed arm and the fuel injector being cylindrical and the axes of the fuel feed arm and the fuel injector being coaxial, the fuel feed arm and the fuel injector being joined together in end-to-end relationship, the fuel feed arm having a fuel passage, the fuel injector comprising a cylindrical body having a passage in communication with the fuel passage in the fuel feed arm, the cylindrical body having an air duct the axis of which is normal to the axes of the fuel injector and the fuel feed arm, the fuel injector having one or more fuel passages, to inject fuel into the air duct.

The present invention also provides combustion equipment for a gas turbine engine comprising a casing, an annular flame tube and a plurality of fuel burners, the casing haviung a circumferential arrangement of equi-spaced holes, the annular flame tube having a corresponding number of equi-spaced holes and a tube extending radially across the annular flame tube through each hole in the annular flame tube coaxial with the corresponding hole in the annular flame tube and the corresponding hole in the casing, each tube being normal to the axis of the annular flame tube, each tube having a duct, the axis of each duct being normal to the axis of the tube and parallel to the axis of the annular flame tube, each fuel burner comprising a fuel feed arm and a fuel injector, the fuel feed arm and the fuel injector being cylindrical and the axes of the fuel feed arm and the fuel injector being coaxial, the fuel feed arm and the fuel injector being joined together in end-to-end relationship, the fuel feed arm having a fuel passage, the fuel injector comprising a cylindrical body having a passage in communication with the fuel passage in the fuel feed arm, the cylindrical body having an air duct the axis of which is normal to the axes of the fuel injector and the fuel feed arm, the fuel injector having one or more fuel passages to inject fuel into the air duct, each fuel burner extending coaxially through the coaxial holes in the casing and the annular flame tube and through the coaxial tube in the annular flame tube, the fuel injector being positioned in the duct in the tube, the axis of the air duct in the fuel injector being parallel to the axis of the duct in the tube.

Figure 3:
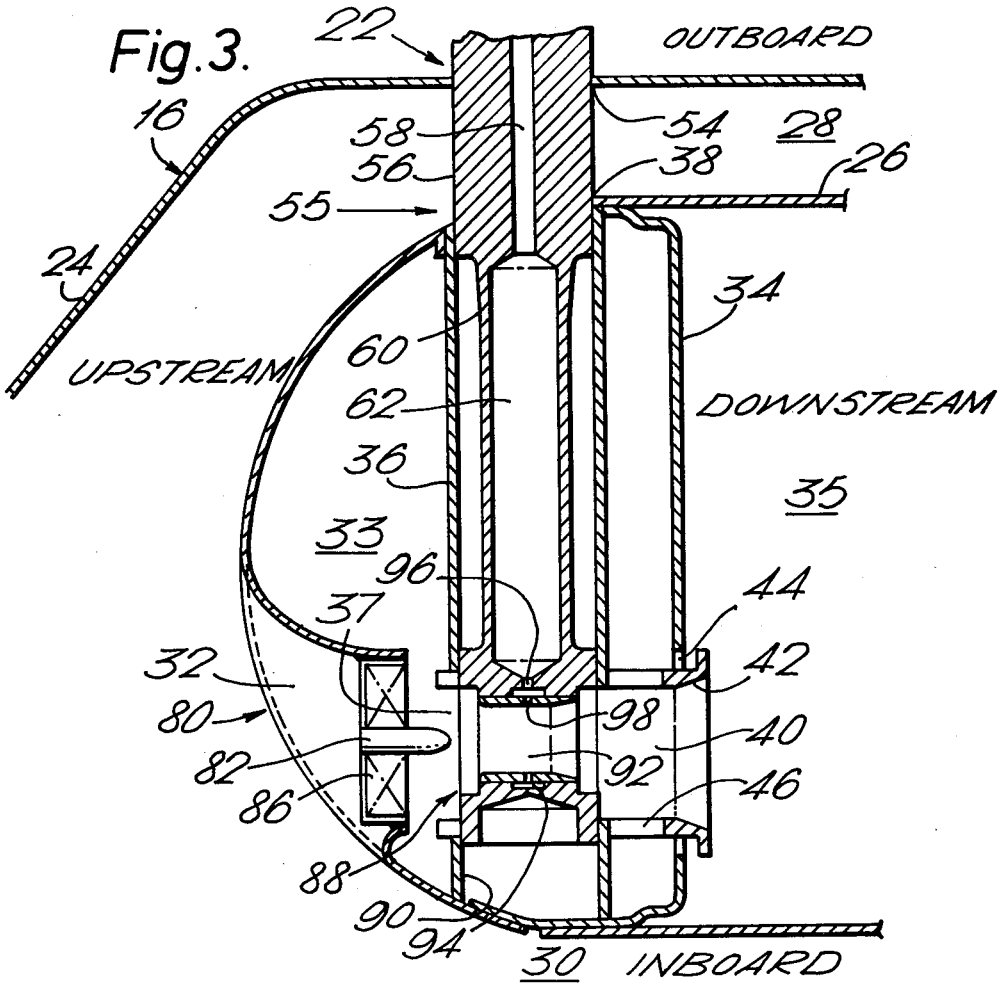
Figure 2:
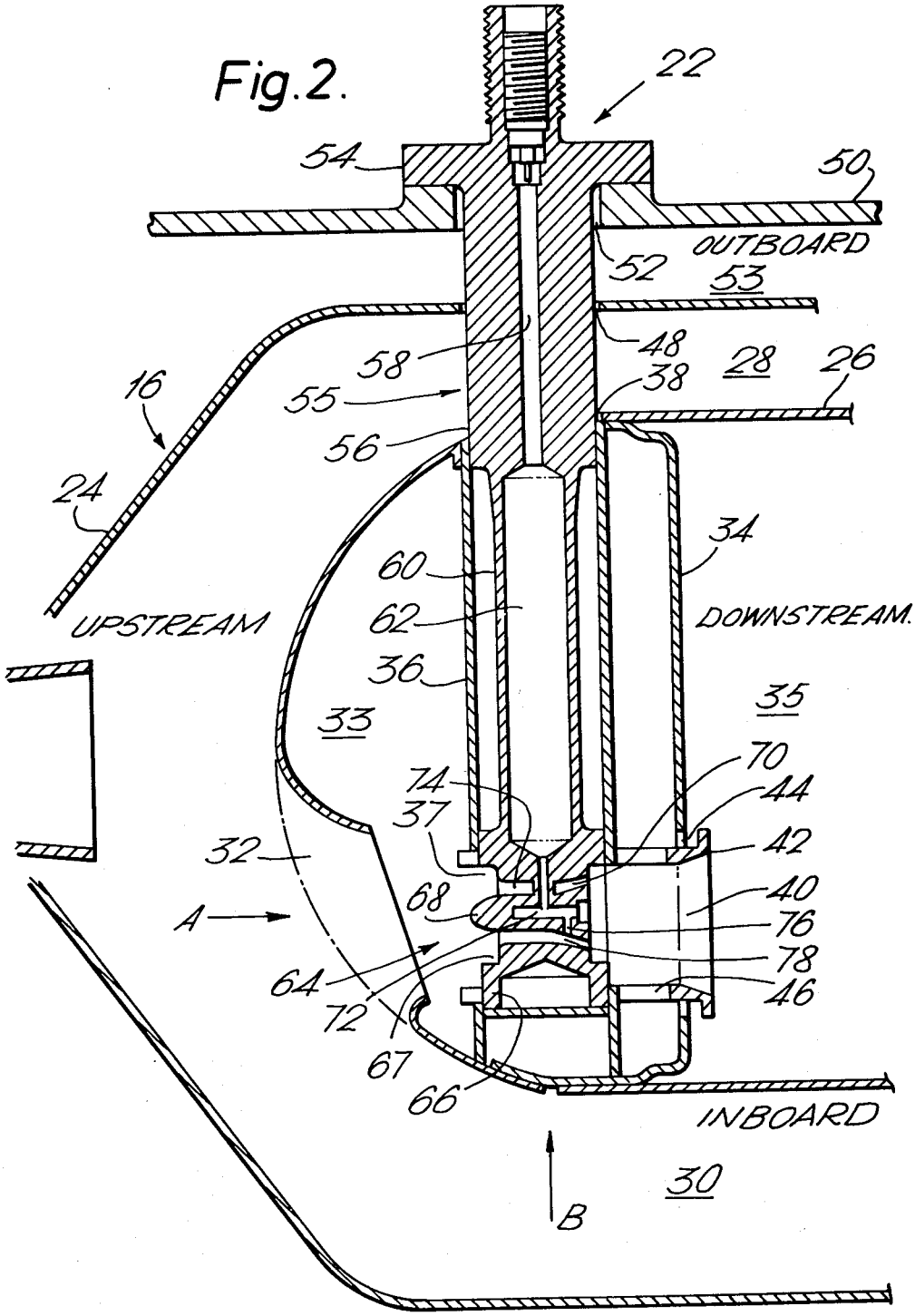
Figure 5:
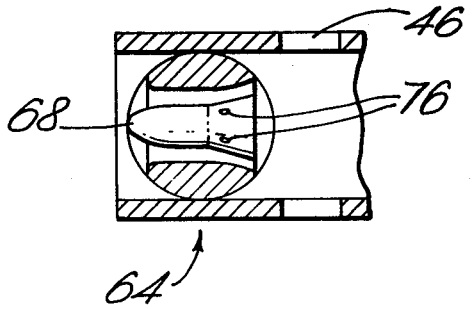
Figure 4:
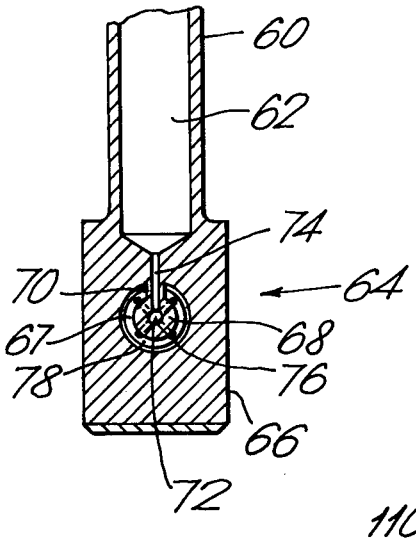

The present invention will be described with reference to the accompanying drawings in which:

FIG. 1 is a cut-away view of a gas turbine having a fuel burner, and combustion equipment according to the present invention, FIG. 2 is a partial cross-sectional view of the fuel burner and upstream end of the combustion equipment in FIG. 1, FIG. 3 is a partial cross-sectional view of an alternative fuel burner according to the invention, FIG. 4 is a view in the direction of arrow A in FIG. 2, and FIG. 5 is a view in the direction of arrow B in FIG. 2.

Figure 7:
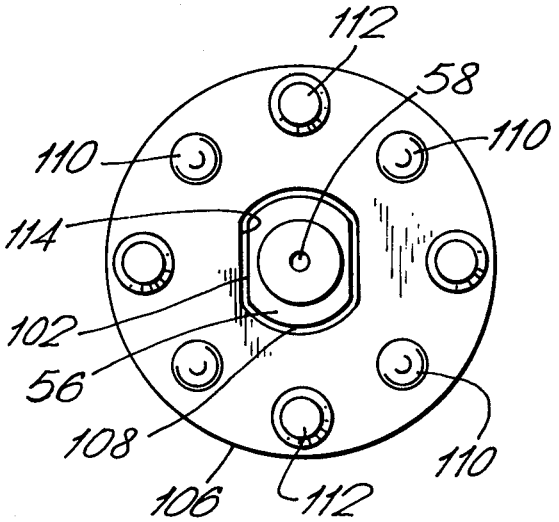
Figure 6:
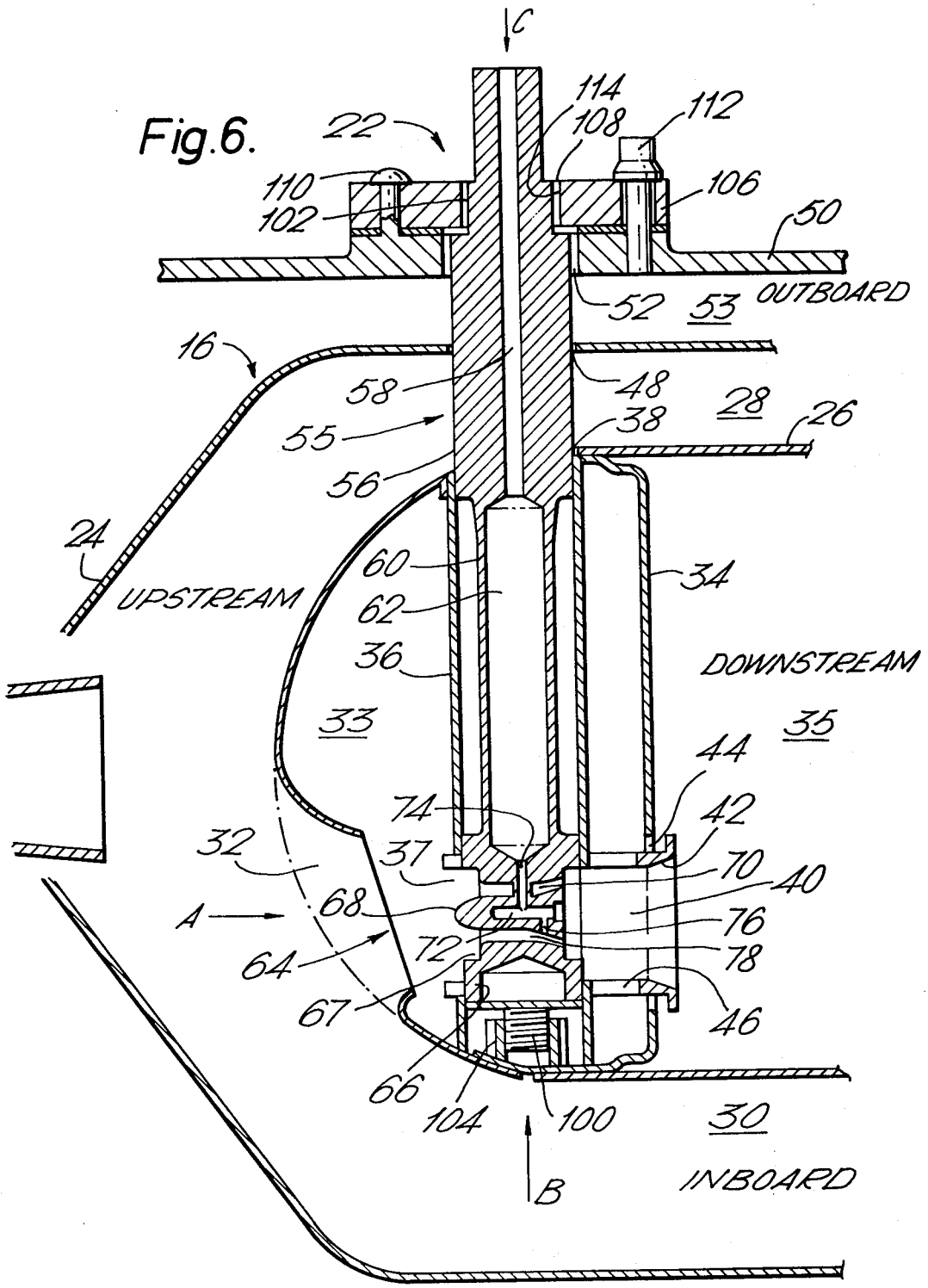

FIG. 6 is a partial cross-sectional view of an alternative fuel burner according to the invention, and FIG. 7 is a view in the direction of arrow C in FIG. 6.

In FIG. 1 is shown a cut-away view of a gas turbine engine 10 comprising a fan 12, a compressor 14, annular combustion equipment 16, a turbine 18 and an exhaust nozzle 20. The annular combustion equipment 16 is fed with fuel from a number of fuel burners 22.

FIGS. 2, 4 and 5 show the fuel burner 22 and the upstream end of the annular combustion equipment 16. The annular combustion equipment 16 comprises an annular wall 24 and an annular flame tube 26, the annular wall 24 being coaxial with and spaced radially outboard of the annular flame tube 26. Annular air passages 28 and 30 are positioned radially outboard and inboard respectively of the annular flame tube 26. The annular combustion equipment 16 is enclosed by a casing 50, and an annular space 53 is defined between the annular wall 24 and the casing 50. The annular flame tube 26 has a number of equi-spaced apertures 32 in the upstream end for the through flow of primary air from the compressor 14 into a chamber 33 in the annular flame tube 26. The chamber 33 is defined by the upstream end of the annular flame tube 26 and a head 34 extending across the annular flame tube 26. Downstream of the head 34 is a primary zone 35 where combustion of primary air and fuel takes place.

The annular flame tube 26 has a number of equi-spaced tubes 36 which are positioned in the chamber 33 and are secured to and extend radially across the annular flame tube 26. The outboard end of each tube 36 at least extends to a hole 38 in the annular flame tube 26, and each tube 36 has a duct 37 which pases through the tube 36, and the duct 37 is normal to the axis of the tube 36 and parallel to the axis of the annular flame tube 26. The head 34 of the annular flame tube 26 has a plurality of apertures 40, and the axis of each aperture 40 being coaxial with a duct 37 in a corresponding tube 36.

A pot 42 is positioned in and coaxially around each aperture 40 in the head 34 of the annular flame tube 26, and a number of air passages 44 are formed between each pot 42 and the head 34 for the flow of air. An air passage 46 is formed between the upstream end of each pot 42 and a tube 36 for the flow of primary air from the chamber 33 into the aperture 40 and the pot 42 before entering the primary zone 35.

The annular wall 24 and the casing 50 have circumferential arrangements of holes 48 and 52 respectively, each hole 48 and 52 in the annular wall 24 and casing 50 respectively being coaxial with the corresponding hole 38 in the annular flame tube 26 and the corresponding tube 36 extending radially across the annular flame tube 26.

A fuel burner 22 is positioned coaxially inside each of the coaxial holes 52, 48 and 38 in the casing 50, the annular wall 24 and the annular flame tube 26 respectively and the tube 36 extending radially across the annular flame tube 26.

Each fuel burner 22 comprises a flange 54, a fuel feed arm 55 and a fuel injector 64. The fuel feed arm comprises cylindrical bodies 56 and 60 which are coaxial and joined in end-to-end abutting relationship. The cylindrical bodies 56 and 60 have fuel passages 58 and 62 respectively for the flow of fuel to the fuel injector 64.

The flange 54 is attached to the outboard end of the fuel feed arm 55 and is used to secure the fuel burner 22 to the casing 50.

The flange 54 is coaxial with and attached to the cylindrical body 56.

The fuel injector 64 comprises a cylindrical body 66 having a duct 67 passing through the cylindrical body 66 and the duct 67 being normal to the axis of the cylindrical body 66. A pintle 68 is positioned coaxially in the duct 67 on an arm 70. The pintle 68 has a fuel chamber 72 which is supplied with fuel from the fuel passage 62 in the fuel feed arm 55 by a fuel passage 74 in the arm 70 and cylindrical body 66.

The fuel chamber 72 in the pintle 68 supplies fuel through a number of radially extending fuel passages 76 into an annular air passage 78, which is formed between the cylindrical body 66 and the pintle 68.

The fuel injector 64 is also coaxial with and attached to the cylindrical body 60.

The fuel burner 22 is positioned inside the tube 36 extending radially across the flame tube 26, and the axis of the duct 67 in the fuel injector 64 is coincident to the axis of the duct 37 in the tube 36, the duct 67 in the fuel injector 64 being in the duct 37 in the tube 36 and the axis of the duct 67 being coaxial with the axis of the aperture 32 in the upstream end of the flame tube 26.

The diameter of each fuel injector 64 is substantially the same as the inside diameter of the corresponding tube 36 extending radially across the annular flame tube 26. A seal is formed between the fuel injector 64 and the tube 36 to restrict the flow of air in a radially outboard or inboard direction along the tube 36.

Similarly the diameter of the cylindrical body 56 is substantially the same as the inside diameter of the tube 36 and forms a seal to restrict the flow of air radially along the tube 36.

The holes 48 and 52 in the annular wall 24 and the casing respectively may have inside diameters substantially the same as the cylindrical body 56, to form seals in order to restrict flow of air from the annular air passage 28 to the annular space 53 and from the annular air space 53 to atmosphere.

FIG. 3 shows a fuel burner 22 similar to the one in FIG. 2, but having a different fuel injector 88. The fuel injector 88 comprises a cylindrical body 90 having a duct 92 passing through the cylindrical body 90 and the duct 92 being normal to the axis of the cylindrical body 90. The cylindrical body 90 has an annular fuel manifold 94 which is supplied with fuel from the fuel passage 62 in the fuel feed arm 55 by a fuel passage 96 in the cylindrical body 90. The axis of the annular fuel manifold 94 is coaxial with the axis of the duct 92. The annular fuel manifold 94 supplies fuel through a number of fuel passages 98 into the duct 92.

The annular flame tube 26 has a swirler assembly 80 positioned in and coaxial with the aperture 32 in the upstream end of the flame tube 26. The swirler asembly comprises a central body 82 and a cylindrical wall 84 with a plurality of swirl vanes 86 extending therebetween.

The axis of the duct 92 in the fuel injector 88 is parallel to the axis of the duct 37 in the tube 36, and the duct 92 in the fuel injector 88 is in the duct 37 in the tube 36, and the axis of the duct 88 is coaxial with the axis of the aperture 32 and the swirler asembly 80 in the upstream end of the annular flame tube 26.

The pots 42 in the head 34 are conical and diverge in a downstream direction, the pots 42 extend in an upstream direction to the downstream face of the tube 36, and air passages are not formed between the pots 42 and the corresponding tubes 36.

FIGS. 6 and 7 show a fuel burner 22 similar to the one in FIG. 2, but having a threaded body 100. The threaded body 100 is attached to and is coaxial with the cylindrical body 66. The fuel burner 22 shown does not have a flange, but has flats 102 on the cylindrical body 56.

A nut 104 is positioned coaxially inside each tube 36, and each nut 104 is secured to the inboard wall of the annular flame tube 26.

The threaded body 100 is screwed into the nut 104 until it locks, it is then unscrewed until a retaining plate 106 having a central slot 108 with rounded ends will fit over and secure the fuel burner 22 to the casing 50. The retaining plate 106 is secured over each hole 52 in the casing 50 by a number of bolts 110 and 112.

The flats 102 on each cylindrical body 56 engage with the faces 114 of the central slot 108 in the corresponding retaining plate 106, and prevent the fuel feed arm 55 from rotating and so ensures that the ducts 37 and 67 in the tube 36 and fuel injector 64 are in alignment.

In operation with reference to FIG. 2, air from the compressor 14 enters the combustion equipment 16 at the upstream end of the combustion equipment 16, the air supplied to the combustion equipment 16 being used for several purposes. Some of the air flows down the annular air passages 28 and 30, and is used for cooling the annular flame tube 26 and as secondary air to complete the combustion process in the annular flame tube 26. The remainder of the air is known as primary air and enters the annular flame tube 26 through the apertures 32 in the upstream end of the annular flame tube 26. Some of the primary air entering the chamber 33 flows around the tube 36 and cools the head 34 before flowing through the air passage 46 and the pot 42 into the primary zone 35, and some of the primary air flows through the passages 44 formed between the pot 42 and the head 34 of the annular flame tube 26, the remainder of the primary air flows into the ducts 37 and 67 in the tube 36 and the fuel injector 64 respectively. The primary air flowing into the duct 67 in the fuel injector 64 flows through the annular air passage 78 where fuel is injected from a number of fuel passages 76 in the pintle 68 into the primary air. The fuel and primary air mixture flows through the pot 40 into the primary zone 35 where the fuel and primary air mixture is ignited by an igniter (not shown) and burnt.

Fuel from a fuel supply (not shown) is supplied to the fuel injector 64 through fuel passages 58 and 62 in the cylindrical bodies 56 and 60 respectively of the fuel feed arm 55. The fuel flows through passage 74 in the cylindrical body 66 and the arm 70 into the fuel chamber 72 in the pintle 68, the fuel is then injected into the annular air passage 78 from the fuel chamber 68 from a number of fuel passages 76.

Similarly with reference to FIG. 3, the primary air entering the chamber 33 through the aperture 32 in the upstream end of the flame tube 26 is given a swirling motion by the swirler assembly 80 positioned coaxially in the aperture 32. Again some of the primary air flows around the tube 36 and cools the head 34 before flowing through the passage 44 formed between the pot 42 and the head 34 of the annular flame tube 26, the remainder of the swirling primary air flows into the ducts 37 and 92 in the tube 36 and the fuel injector 88 respectively. Fuel is injected into the swirling primary air flowing through the duct 92 from a number of fuel passages 98 in the cylindrical body 90. The fuel and primary air mixture flows through the pot 40 into the primary zone 35 where the fuel and primary air mixture is ignited and burnt.

Fuel from a fuel supply is supplied to the fuel injector 88 through fuel passages 58 and 62 in the cylindrical bodies 56 and 60 respectively of the fuel feed arm 55. The fuel flows through fuel passage 96, in the cylindrical body 90 into the annular fuel manifold 94, the fuel is then injected into the duct 92 from the annular fuel manifold 94 from a number of fuel passages 96.

The operation of the fuel burner 22 as shown in FIG. 6 is similar to the operation of the fuel burner 22 as shown in FIG. 2.

The fuel burner 22 is prevented from moving in a radially outboard direction because of the threaded body 100 screwing into the nut 102 attached to the inboard wall of the annular flame tube 26, and ensures the ducts 37 and 67 in the tubes 36 and fuel injectors 64 respectively remain in alignment when the annular flame tube 26 expands due to the high temperatures generated during the combustion process or because of vibrations in the engine.

Although the invention has been described with reference to an annular flame tube it could equally well be adapted for use in can annular or tubular flame tubes.

In these cases a single tube 36 would extend across each flame tube 26 and be adapted to receive a fuel burner 22 as described.

The pots 42 may equally well be cylindrical or conical, and they may or may not form air passages 46 between the upstream end of each pot 42 and the downstream face of the corresponding tube 36.

The invention may also be applied to annular combustion equipment 16 which has no annular wall 24 between the annular flame tube 26 and the casing 50.

The invention may not be limited to the fuel burners as described, i.e. airspray injectors, fuel burners with other types of fuel injectors may be used providing the fuel injector has a cylindrical body with a duct passing normally through the cylindrical body i.e. it may be of the air-atomising type.

I claim:

1. Combustion equipment for a gas turbine engine comprising:

an annular casing having a plurality of circumferentially arranged equi-spaced holes;

an annular flame tube coaxially positioned within and spaced from said annular casing, said annular flame tube having a corresponding number of circumferentially equi-spaced holes coaxially aligned with the holes of said casing:

a plurality of tubes extending radially across said annular flame tube, each tube being coaxial with the corresponding hole in the annular flame tube and the corresponding hole in the annular casing, each tube extending normal to an axis of said annular flame tube, each tube having a duct extending therethrough with an axis normal to the axis of the tube and parallel to the axis of said annular flame tube;

a plurality of fuel burners, each fuel burner comprising a cylindrical fuel feed arm having a fuel passage therethrough, a fuel injector having a cylindrical body coaxial with and joined in end-to-end relationship with said cylindrical fuel feed arm, said fuel injector having a first passage in said cylindrical body communicating with said fuel feed passage in said fuel feed arm, said fuel injector having an air duct extending through said cylindrical body thereof, said air duct having an axis normal to the axes of said cylindrical body of the fuel injector and said fuel feed arm, said fuel injector having at least a second passage in said cylindrical body communicating with said first passage therein and with said air duct for injecting fuel into said air duct, each fuel burner extending coaxially through aligned holes in said annular casing and said annular flame tube and through the radial tube in said flame tube, said fuel injector of said fuel burner being positioned in said duct in said radial tube, the axis of said air duct in said cylindrical body being coincident with the axis of the duct in said radial tube.

2. Combustion equipment as claimed in claim 1 in which each fuel injector has a threaded body, the axes of each fuel injector and the corresponding threaded body being coaxial, each threaded body screwing into a corresponding nut secured to the annular flame tube, the axis of each nut being coaxial with the axis of the corresponding tube.

3. Combustion equipment as claimed in claim 2 in which the diameter of each fuel injector is substantially the same as the inside diameter of the corresponding tube extending radially across the annular flame tube.

4. Combustion equipment as claimed in claim 3 in which the diameters of each fuel feed arm and each fuel injector respectively are substantially the same as the inside diameters of the corresponding tube extending radially across the annular flame tube, and the corresponding hole in the casing.

5. Combustion equipment as claimed in claim 4 in which the annular flame tube has a head, the head having a number of equi-spaced apertures with a pot positioned coaxially inside each aperture, the axis of each aperture in the head being aligned with the corresponding axis of the duct in the tube and the corresponding axis of the air duct in the fuel injector, a number of air passages being formed between the pot and the head.

6. Combustion equipment as claimed in claim 5 in which the pots have a circular cross section.

7. Combustion equipment as claimed in claim 6 in which the pots are cylindrical.

8. Combustion equipment as claimed in claim 6 in which the pots diverge in a downstream direction.

9. Combustion equipment as claimed in claim 6 in which the upstream end of the annular flame tube has a number of equi-spaced apertures aligned with the air ducts of the fuel burners.

10. Combustion equipment as claimed in claim 9 in which each aperture in the upstream end of the annular flame tube has an air swirler.

* * * * *